US005509500A

United States Patent [19]

Delagera

[11] Patent Number: 5,509,500

[45] Date of Patent: Apr. 23, 1996

[54] GUTTER GUARD PROTECTOR AND ANTI-SLIP LADDER DEVICE

[76] Inventor: Joseph Delagera, 139 West Ave., Hicksville, N.Y. 11801

[21] Appl. No.: 320,697

[22] Filed: Oct. 11, 1994

[51] Int. Cl.[6] ..... E04G 3/00

[52] U.S. Cl. ..... 182/107; 182/214

[58] Field of Search ..... 182/107, 214, 182/229; 248/48.1, 48.2; 52/11

[56] References Cited

U.S. PATENT DOCUMENTS 4,185,421 1/1980 Robinson ..... 248/48.2 X
5,215,163 1/1993 Kent ..... 182/214 X

FOREIGN PATENT DOCUMENTS 493868 2/1978 Australia ..... 182/214

*Primary Examiner*—Alvin C. Chin-Shue
*Attorney, Agent, or Firm*—Michael I. Kroll

[57] ABSTRACT

A gutter guard protector and anti-slip ladder device for a roof on a building comprising an assembly that is insertable into the gutter, for preventing the top portions of the side rails of the ladder from crushing the front segment of the gutter when placed against it. A structure on the assembly is for preventing the top portion of the side rails of the ladder from sliding off when placed thereagainst.

1 Claim, 3 Drawing Sheets

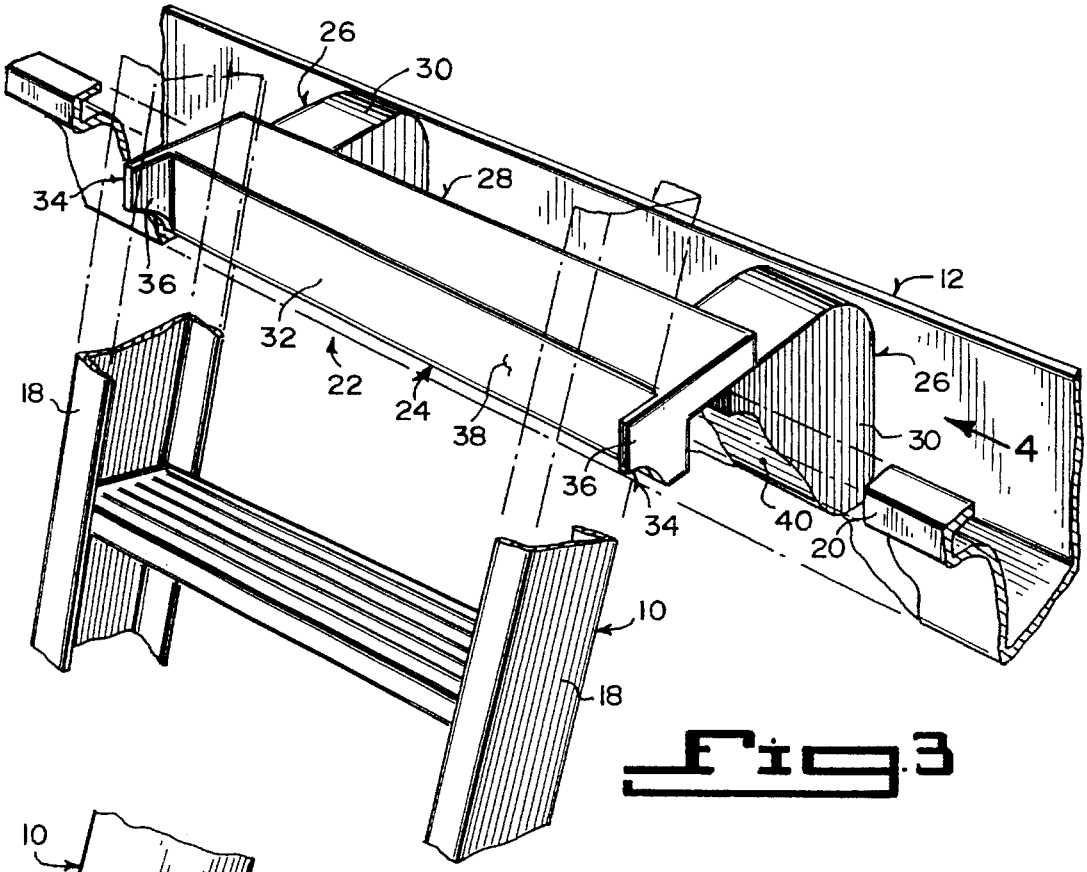
fig.3
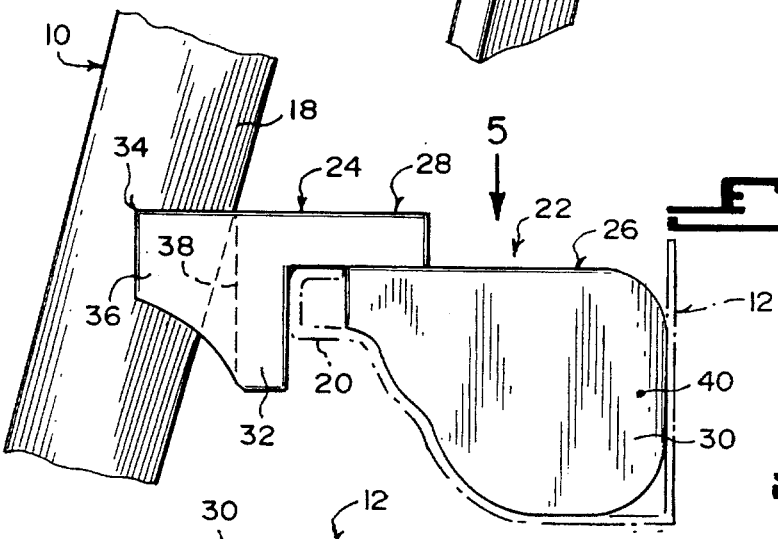
fig.4
fig.5
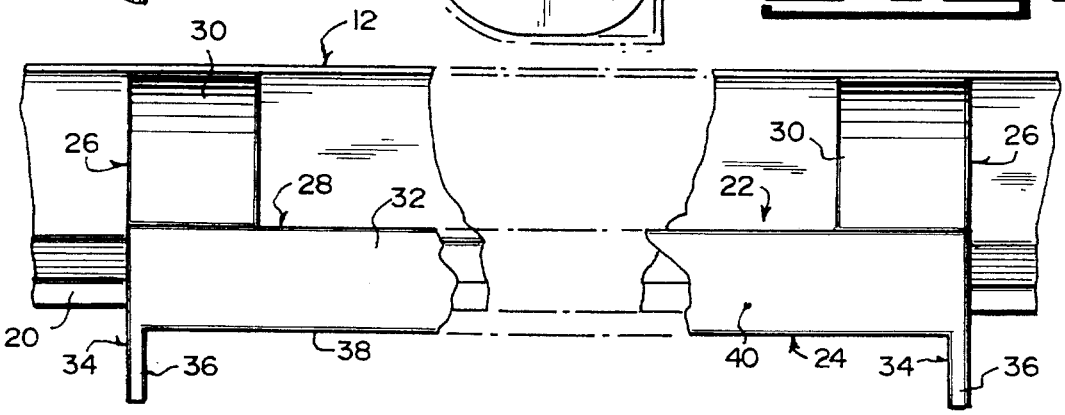

GUTTER GUARD PROTECTOR AND ANTI-SLIP LADDER DEVICE

BACKGROUND OF THE INVENTION

1. Field of the Invention

The instant invention relates generally to drain systems for roofs and more specifically it relates to a gutter guard protector and anti-slip ladder device.

2. Description of the Prior Art

Numerous drain systems for roofs have been provided in prior art that are adapted include gutters that catch rainwater from roofs and carry it to leaders extending to the ground. When a ladder is placed against the front of a gutter it will crush and scratch the gutter and slide along it. While these units may be suitable for the particular purpose to which they address, they would not be as suitable for the purposes of the present invention as heretofore described.

SUMMARY OF THE INVENTION

A primary object of the present invention is to provide a gutter guard protector and anti-slip ladder device that will overcome the shortcomings of the prior art devices.

Another object is to provide a gutter guard protector and anti-slip ladder device that can be inserted into a gutter to prevent a top of the side rails of the ladder from crushing the front segment of the gutter when placed thereagainst.

An additional object is to provide a gutter guard protector and anti-slip ladder device that contains side flanges to prevent the top of the side rails of the ladder from sliding off when placed against the device.

A further object is to provide a gutter guard protector and anti-slip ladder device that is simple and easy to use.

A still further object is to provide a gutter guard protector and anti-slip ladder device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a perspective view of the instant invention in the gutter with parts broken away and in phantom, showing the top of the side rails of the ladder being held within by the side flanges.

FIG. 4 is an end view taken in the direction of arrow 4 in FIG. 3, showing the gutter in phantom.

FIG. 5 is a top view taken in the direction of arrow 5 in FIG. 4, with parts broken away and the ladder removed therefrom.

DETAILED DESCRIPTION OF THE PREFERRED EMBODIMENTS

Figure 1:
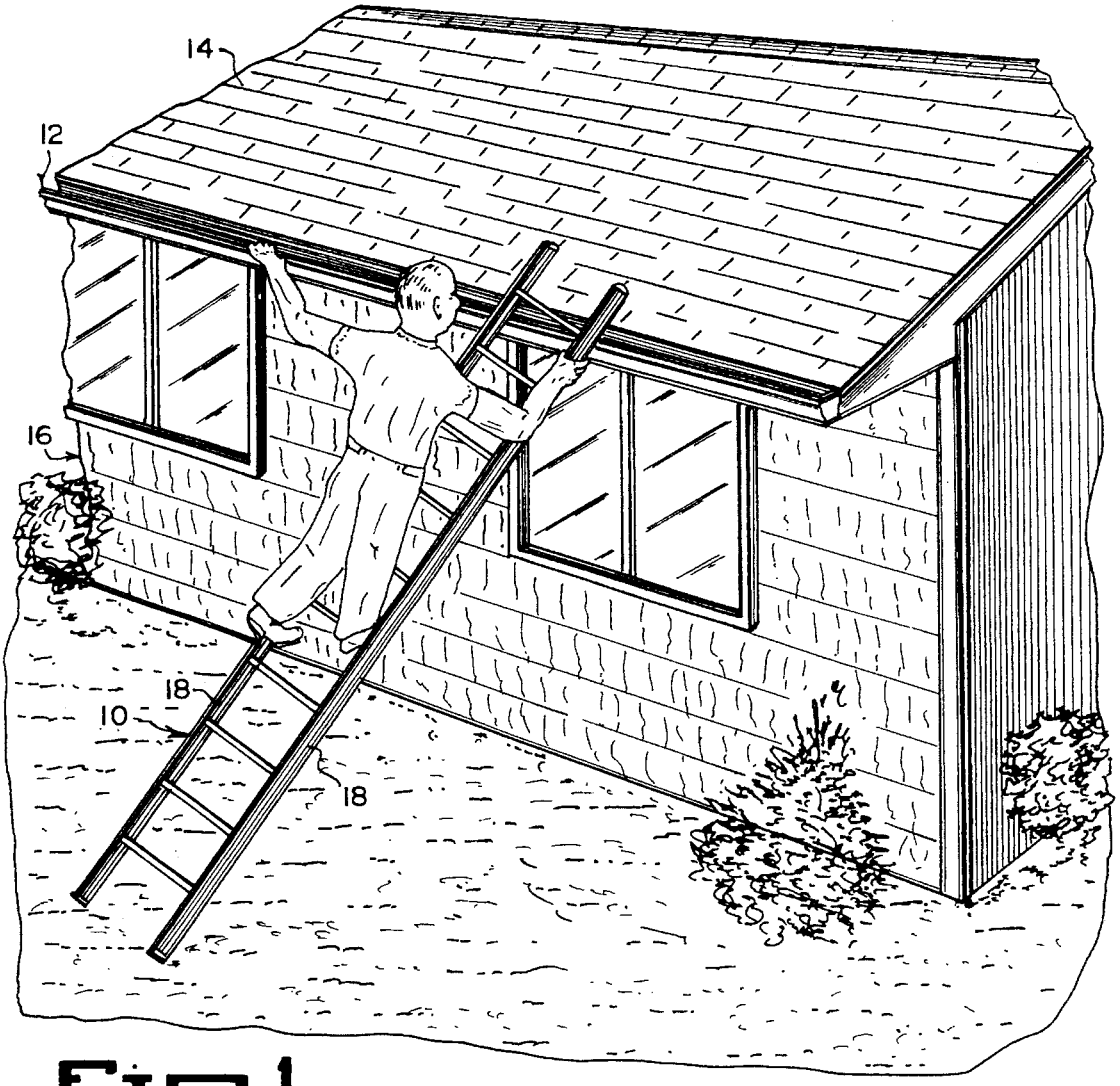
FIG. 1 is a perspective view of the prior art showing a ladder sliding off a gutter on a roof of a building.
Figure 1A:
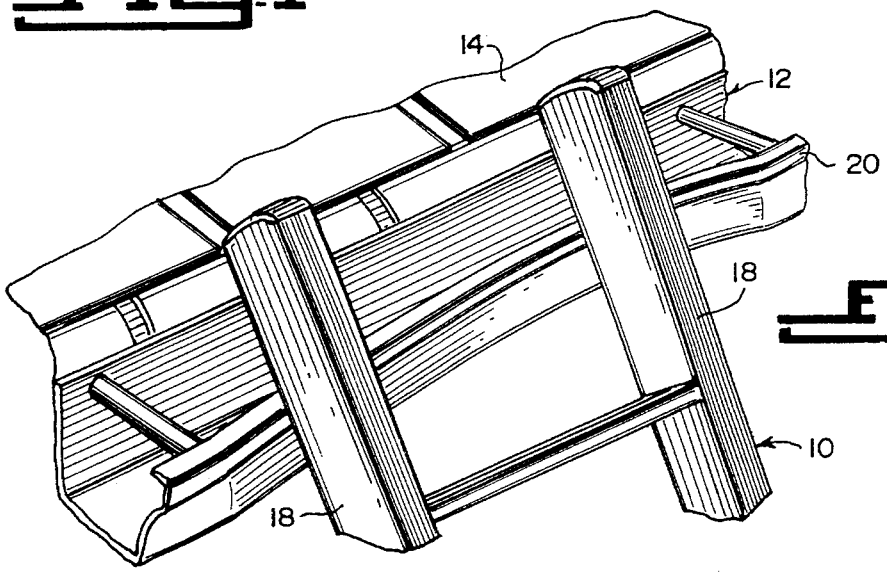
FIG. 1A is an enlarged perspective view of the prior art showing the top of the side rails of the ladder crushing the front of the gutter.
Figure 2:
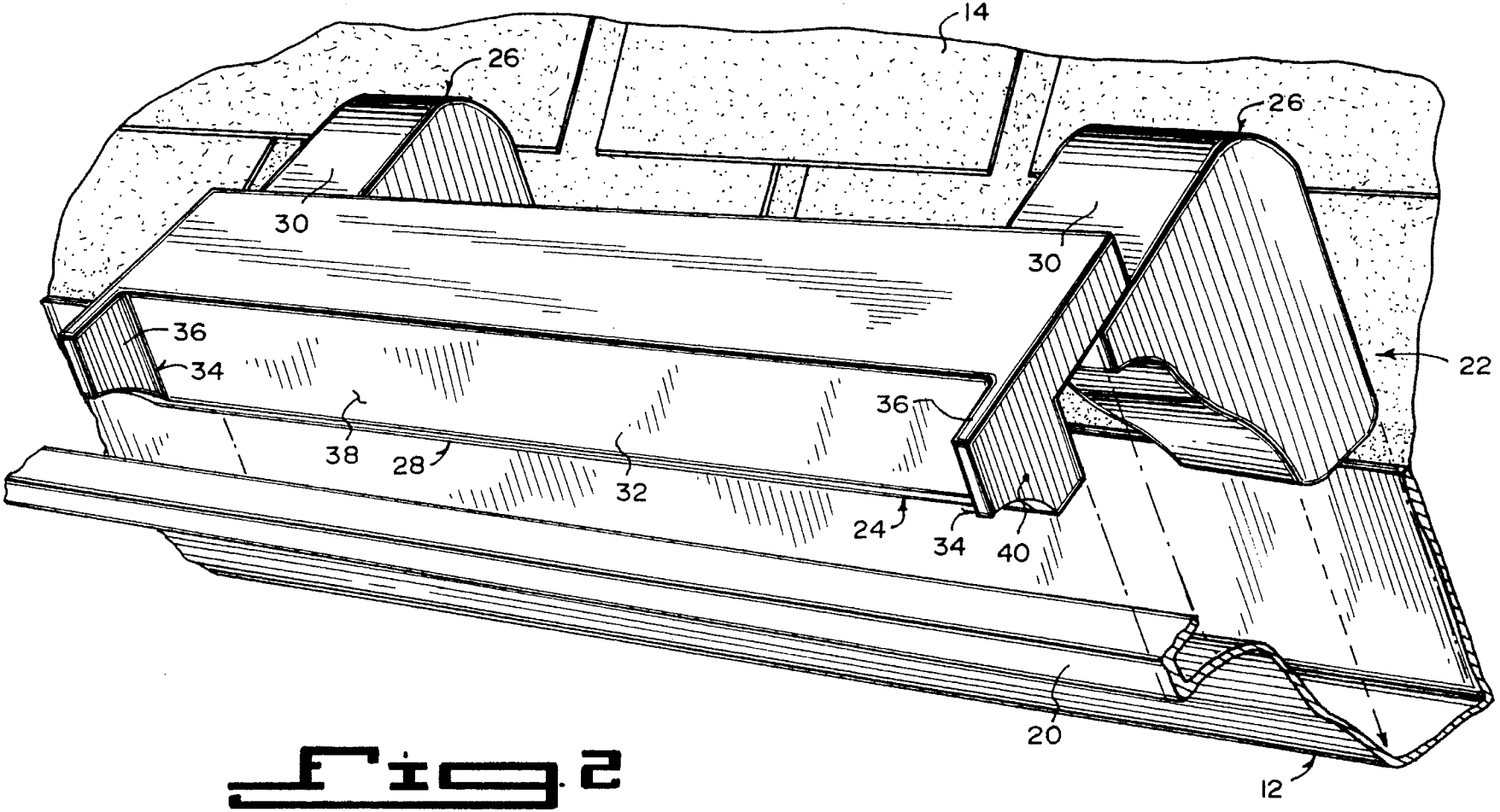
FIG. 2 is a perspective view of the instant invention being inserted into a gutter.

Turning now descriptively to the drawings, in which similar reference characters denote similar elements throughout the several views, FIGS. 1 and 1A show the prior art. In FIG. 1, a ladder 10 is sliding off a gutter 12 on a roof 14 of a building 16. In FIG. 1A the top portions of the side rails 18 of the ladder 10 are crushing the front segment 20 of the gutter 12.

The instant invention shown in FIGS. 2 through 5 is a gutter guard protector and anti-slip ladder device 22, comprising an assembly 24 insertable into the gutter 12, for preventing the top portions of the side rails 18 of the ladder 10 from crushing the front segment 20 of the gutter 12 when placed against it.

The crushing preventing assembly 24 includes a pair of inserts 26 to fit into the gutter 12. A crossbar 28 is attached to the inserts 26, which are spaced apart. The crossbar 28 will protect the front segment 20 of the gutter 12, when the top portions of the side rails 18 of the ladder 10 are placed against the crossbar 28.

Each insert 26 is a block member 30 externally shaped to fit into and match up with the internal shape of the gutter 12. The crossbar 28 is an L-shaped channel 32 sized to fit over the front segment 20 of the gutter 12, to receive the top portions of the side rails 18 of the ladder 10.

The gutter guard protector and anti-slip ladder device 22 further includes a structure 34 on the L-shaped channel 32, for preventing the top portion of the side rails 18 of the ladder 10 from sliding off when placed thereagainst. The sliding preventing structure 34 includes a pair of forward facing flanges 36 on a front surface 38 of the L-shaped channel 32 spaced apart to receive the top portion of the side rails 18 of the ladder 10. The flanges 36 are integral with the front surface 38 of the L-shaped channel 32.

The block member 30, the L-shaped channel 32 and the flanges 36 are all fabricated out of a durable strong material 40. The durable strong material 40 can be metal, plastic or wood.

OPERATION OF THE INVENTION

To use the anti-slip protector device for a gutter guard protector and anti-slip ladder device 22, the following steps should be taken:

1. Insert the block members 30 into the gutter 12, so that the L-shaped channel 32 extends over the front segment 20.
2. Place the top portions of the side rails 18 of the ladder 10 against the front surface 38 of the L-shaped channel 32 between the forward facing flanges 36.
3. Climb the ladder 10 without crushing the front segment 20 of the gutter 12, while the top portions of the side rails 18 of the ladder 10 will be held within the forward facing flanges 36.
4. Remove the top portions of the rails 18 of the ladder 10 from the front surface 38 of the L-shaped channel 32 when the work is done.
5. Take the block members 30 out of the gutter 12, so that the device 22 can be stored for future use.

LIST OF REFERENCE NUMBERS

10 ladder
12 gutter
14 roof

16 building
18 side rail of 10
20 front segment of 12
22 gutter guard protector and anti-slip ladder device
24 crushing preventing assembly
26 insert
28 crossbar
30 block member for 26
32 L-shaped channel for 28
34 sliding preventing structure
36 forward facing flange
38 front surface of 32
40 durable strong material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A gutter guard protector and anti-slip ladder device in combination with a gutter for a roof on a building comprising means insertable into the gutter for preventing the top portions of the side rails of the ladder from crushing the front segment of the gutter when placed against it, said insertable means including a crossbar extending parallel to said gutter having an L-shaped configuration on one side straddling a top outer edge of said gutter and a pair of inserts located at and attached to opposite ends of said crossbar extending into and terminating in and resting unattached to and readily removable on the bottom of said gutter, said inserts joined to said crossbar at a lower surface of a horizontal leg of said L-shaped configuration which runs along the top outer edge of said gutter, said inserts being spaced from each other and not joined together within said gutter, said crossbar having an outwardly facing vertical surface for receiving the side rails of said ladder along the top edge of said vertical surface on said crossbar and a pair of forward facing flanges at opposite ends of said crossbar to prevent the side rails of said ladder from sliding off the side of said crossbar, the crossbar and said inserts closely fitting the outer edge of said gutter within the space formed by said L-shape and outer ends of said inserts.

* * * * *